US010889467B2

(12) United States Patent
Wroblewski

(10) Patent No.: US 10,889,467 B2
(45) Date of Patent: Jan. 12, 2021

(54) SYNCHRONIZATION BASED ON DISTANCE OF MAGNET ASSEMBLY TO RAIL

(71) Applicant: OTIS ELEVATOR COMPANY, Farmington, CT (US)

(72) Inventor: Marcin Wroblewski, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 443 days.

(21) Appl. No.: 15/974,355

(22) Filed: May 8, 2018

(65) Prior Publication Data

US 2019/0345002 A1 Nov. 14, 2019

(51) Int. Cl.

| | |
|---|---|
| ***B66B 5/06*** | (2006.01) |
| ***B66B 5/18*** | (2006.01) |
| ***B66B 7/02*** | (2006.01) |

(52) U.S. Cl.

CPC ..... *B66B 5/06* (2013.01); *B66B 5/18* (2013.01); *B66B 7/02* (2013.01)

(58) Field of Classification Search

CPC ..... B66B 5/06; B66B 5/18; B66B 7/02
USPC ..... 187/288
See application file for complete search history.

(56) References Cited

U.S. PATENT DOCUMENTS 5,117,946 A 6/1992 Traktovenko et al.
5,159,995 A 11/1992 Sissala et al.
5,503,257 A * 4/1996 Sugita ..... B66B 5/18 188/250 B
5,518,087 A * 5/1996 Hwang ..... B66B 5/18 187/374
5,814,774 A 9/1998 Remmers et al.
6,131,704 A * 10/2000 Viita-Aho ..... B66B 7/047 188/44

(Continued)

FOREIGN PATENT DOCUMENTS

CN 1111501 C 6/2003
CN 101107190 A 1/2008

(Continued)

OTHER PUBLICATIONS

Search Report dated Oct. 11, 2019 in U321185EP, EP Application No. 19173165.2, 7 pages.

*Primary Examiner* — David S Warren
(74) *Attorney, Agent, or Firm* — Cantor Colburn LLP

(57) ABSTRACT

An elevator system is provided and includes at least one guide rail, safeties to respectively selectively impede or permit movement of an elevator car along a corresponding guide rail and first and second electronic safety actuators (ESAs) respectively coupled to a corresponding safety. The first ESA includes a first braking surface located a first distance from the corresponding guide rail, the second ESA includes a second braking surface located a second distance from the corresponding guide rail and the first and second braking surfaces are deployable across the first and second distances, respectively, to contact the corresponding guide rails. The elevator system further includes a sensing system to determine the first and second distances and a control system to deploy the first and second braking surfaces toward the corresponding guide rails in response to an over-speed or an over-acceleration condition with synchronization based on the first and second distances.

19 Claims, 5 Drawing Sheets

(56) References Cited

U.S. PATENT DOCUMENTS

| | | | | |
|---|---|---|---|---|
| 6,338,396 | B1 | 1/2002 | Morishita | |
| 6,401,872 | B1 | 6/2002 | Morishita | |
| 7,014,013 | B2 | 3/2006 | Fujita | |
| 8,002,086 | B2 | 8/2011 | Ito | |
| 8,091,686 | B2 | 1/2012 | Ito | |
| 8,342,294 | B2 | 1/2013 | Michaus et al. | |
| 8,550,217 | B2 | 10/2013 | Valjus et al. | |
| 9,027,714 | B2 | 5/2015 | Husmann et al. | |
| 9,114,954 | B2 | 8/2015 | Boschin et al. | |
| 9,457,989 | B2 | 10/2016 | Meierhans et al. | |
| 9,688,512 | B2 * | 6/2017 | West | B66B 5/18 |
| 9,821,983 | B2 * | 11/2017 | Billard | B66B 5/22 |
| 9,975,732 | B2 * | 5/2018 | Annen | B66B 5/06 |
| 10,358,320 | B2 * | 7/2019 | Bitzi | B66B 9/00 |
| 10,562,739 | B2 * | 2/2020 | Hu | B66B 5/22 |
| 2008/0296098 | A1 * | 12/2008 | Sato | B66B 5/22 187/376 |
| 2011/0088983 | A1 * | 4/2011 | Sirigu | B66B 5/22 187/373 |
| 2011/0278097 | A1 * | 11/2011 | Altenburger | B66B 7/027 187/255 |
| 2012/0222918 | A1 * | 9/2012 | Billard | B66B 5/22 187/359 |
| 2014/0158476 | A1 * | 6/2014 | Wei | B66B 5/22 188/65.1 |
| 2015/0240894 | A1 * | 8/2015 | Piech | F16D 63/008 188/163 |
| 2016/0280511 | A1 * | 9/2016 | Anderson | B66B 5/0031 |
| 2017/0217726 | A1 | 8/2017 | Guilani | |
| 2017/0291793 | A1 * | 10/2017 | Bitzi | B66B 1/32 |
| 2017/0291794 | A1 * | 10/2017 | Bitzi | B66B 1/32 |
| 2018/0044136 | A1 * | 2/2018 | Kakio | B66B 5/22 |
| 2018/0327224 | A1 * | 11/2018 | Billard | B66B 5/22 |
| 2019/0047820 | A1 * | 2/2019 | Cao | B66B 5/04 |
| 2019/0062113 | A1 * | 2/2019 | Hu | B66B 5/18 |
| 2019/0345002 | A1 * | 11/2019 | Wroblewski | B66B 5/18 |
| 2020/0198932 | A1 * | 6/2020 | Hallikainen | B66B 5/04 |
| 2020/0207575 | A1 * | 7/2020 | Koskinen | B66B 5/18 |

FOREIGN PATENT DOCUMENTS

| | | | |
|---|---|---|---|
| CN | 101148233 | A | 3/2008 |
| CN | 101535163 | A | 9/2009 |
| CN | 106516933 | A | 3/2017 |
| CN | 106660744 | A | 5/2017 |
| CN | 207243198 | U | 4/2018 |
| JP | 07165376 | A | 6/1995 |
| JP | 4761879 | B2 | 8/2011 |

* cited by examiner

SYNCHRONIZATION BASED ON DISTANCE OF MAGNET ASSEMBLY TO RAIL

BACKGROUND

The following description relates to elevator systems and, more specifically, to elevator systems that have synchronization capability based on a distance between a magnet assembly and a rail.

Elevator systems generally make use of governor systems to monitor the rate of descent of an elevator car and to engage safety devices in an event the elevator car descends at an excessive speed. A typical governor system would be responsive to elevator car speeds through couplings, such as a governor sheave coupled to a rope that is attached to an elevator car, whereby the rope transmits elevator car speed to the governor. When a predetermined speed is exceeded, conventional actuators, such as centrifugal flyweights, trigger a first set of switches. If the car speed continues to increase, additional mechanics engage to impede elevator car movement.

In modern elevator systems, electronic safety actuators (ESAs) may replace governor systems. Whereas governor systems employ mechanical linkages between safeties on the elevator car and ensure that all safeties are engaged at the same time or within acceptable limits of synchronization, each safety in an ESA system typically engages using separate magnet assemblies deployed onto the rail using an electro-magnet and flight times or distances to rails impact synchronization.

BRIEF DESCRIPTION

According to an aspect of the disclosure, an elevator system is provided and includes at least one guide rail, a plurality of safeties to respectively selectively impede or permit movement of an elevator car along a corresponding guide rail and first and second electronic safety actuators (ESAs) respectively coupled to at least one corresponding safety. The first ESA includes a first braking surface located a first distance from the corresponding guide rail, the second ESA includes a second braking surface located a second distance from the corresponding guide rail and the first and second braking surfaces are deployable across the first and second distances, respectively, to contact the corresponding guide rails. The elevator system further includes a sensing system to determine the first and second distances and a control system to deploy the first and second braking surfaces toward the corresponding guide rails in response to an over-speed or an over-acceleration condition with synchronization based at least in part on the first and second distances.

In accordance with additional or alternative embodiments, the sensing system includes a sensor respectively disposed in or adjacent to each ESA.

In accordance with additional or alternative embodiments, the sensor includes a magnetic element and a Hall Effect sensor.

In accordance with additional or alternative embodiments, the control system is configured to calculate a response time for each ESA based on the first and second distances and delay times for each ESA to stagger deployments based on the response times.

According to an aspect of the disclosure, an elevator system in which an elevator car moves along guide rails is provided. The elevator system includes safeties to occupy engaged or unengaged positions relative to a corresponding guide rail to impede or permit movement of the elevator car, respectively, electronic safety actuators (ESAs) respectively coupled to a corresponding safety, a sensing system and a control system. Each ESA includes a braking surface that is normally disposed at a distance from a corresponding guide rail and deployable toward the corresponding guide rail to bring the corresponding safety into the engaged position. The sensing system determines respective distances between each braking surface of each ESA and the corresponding guide rail. The control system to deploy each braking surface of each ESA toward the corresponding guide rail in response to an over-speed or an over-acceleration condition based on the respective distances.

In accordance with additional or alternative embodiments, the safeties each include wedge elements configured to engage with the corresponding guide rail and linkages are provided between each ESA and the corresponding safety.

In accordance with additional or alternative embodiments, the ESA each include a housing, a permanent magnet assembly including the braking surface and electromagnetic actuators disposed in the housing to generate magnetic force to repel the permanent magnet assembly toward the corresponding guide rail when energized.

In accordance with additional or alternative embodiments, the electromagnetic actuators are symmetrically arranged in the housing.

In accordance with additional or alternative embodiments, a power system by which the electromagnetic actuators are powered is coupled to the control system.

In accordance with additional or alternative embodiments, the sensing system includes a sensor respectively disposed in or adjacent to each ESA.

In accordance with additional or alternative embodiments, the sensor includes a magnetic element and a Hall Effect sensor.

In accordance with additional or alternative embodiments, the control system comprises a controller coupled to the elevator car and wiring by which the ESAs are communicative with the controller.

In accordance with additional or alternative embodiments, the controller is centralized.

In accordance with additional or alternative embodiments, the controller is distributed to each ESA.

In accordance with additional or alternative embodiments, the controller is distributed to a smart one of the ESAs and controls the other ESAs.

In accordance with additional or alternative embodiments, the control system is configured to calculate a response time for each ESA based on the respective distances and delay times for each ESA to stagger deployments based on the response times.

According to an aspect of the disclosure, a method of operating an elevator system in which an elevator car moves along guide rails is provided. The method includes providing safeties in unengaged positions relative to corresponding guide rails, disposing electronic safety actuators (ESAs), which are respectively coupled corresponding safeties, such that braking surfaces of the ESAs are at respective distances from corresponding guide rails, sensing the respective distances and deploying the braking surfaces toward the corresponding guide rails to bring the corresponding safeties into engaged positions based on an over-speed or an over-acceleration condition with synchronization based on the respective distances.

In accordance with additional or alternative embodiments, the deploying with synchronization includes calculating a response time for each ESA based on the respective distances and calculating delay times for each ESA to stagger deployments based on the response times.

In accordance with additional or alternative embodiments, the calculating of the response time for each ESA includes testing each ESA, determining responsiveness characteristics of each ESA from the testing and calculating the response time for each ESA based on the respective distances and the determined responsiveness characteristics of each ESA.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a magnet assembly to rail distance sensing mechanism is provided to improve the synchronization of safety engagements in an electronic safety actuator (ESA) system. Different ways of measuring distances to rails exist and one unique way is to use a magnet and an analog Hall Effect sensor to measure the magnetic flux level through a piece of ferrous material as the magnet to rail distance varies (one could potentially use existing ESA electromagnets and magnet assemblies). Once the distance to rail of each magnet assembly is known, a control system can appropriately offset a time of deployment for each magnet assembly to thereby synchronize the point in time at which each magnet assembly makes contact with its rail. This, in turn produces the force to lift the safeties into engagement positions with synchronization.

The approach described herein generally assumes that magnet assemblies to rail flight times can be determined ahead of time and in a consistent manner that can be proportional with respect to distances to rails.

Figure 1:
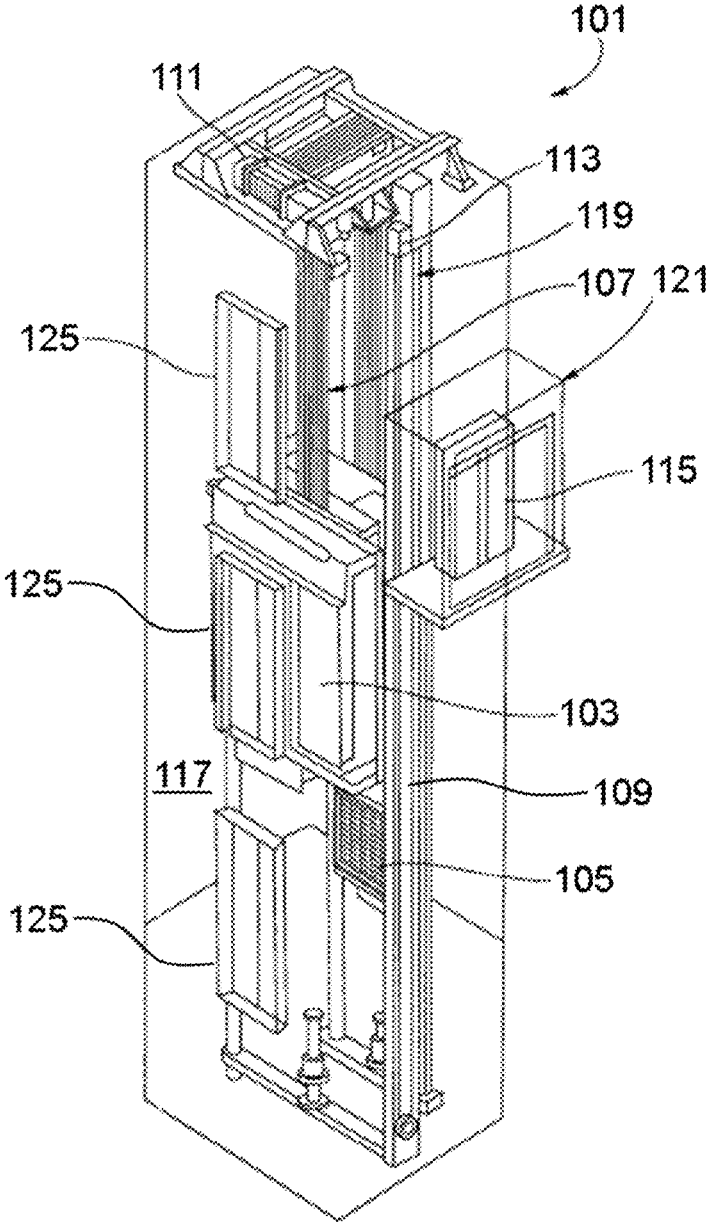
FIG. 1 is a perspective view of an elevator system in accordance with embodiments.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
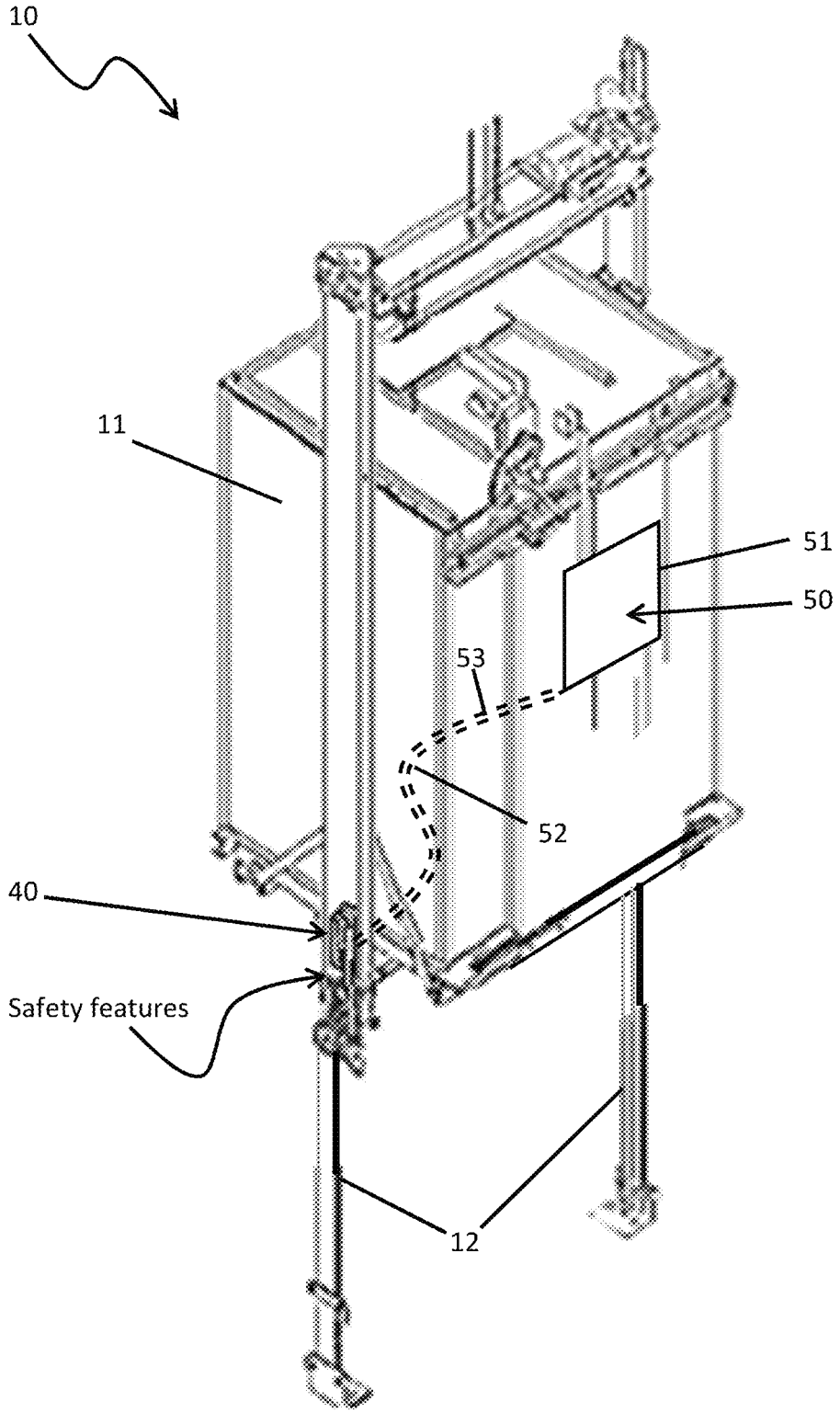
FIG. 2 is a perspective view of an elevator system with electronically actuated safeties in accordance with embodiments.

With reference to FIG. 2, a particular elevator system 10 is provided and may be configured in a similar manner as the elevator system 101 of FIG. 1. In the elevator system 10 of FIG. 2, an elevator car 11 moves from one floor to another in a building or structure along guide rails 12. In most instances, the elevator car 11 has a body, which is configured to accommodate one or more passengers and baggage, doors which open and close to permit entry and exit from the interior and a control panel that allows the passengers to input commands into the elevator system 10. The elevator system 10 also has a driving element that drives the elevator car 11 between each floor in an ascending or descending direction.

In an event the elevator car 11 begins to ascend or descend too quickly, the elevator system 10 also has safety features that can be engaged to slow the elevator car 11 down or to stop it altogether.

Figure 3:
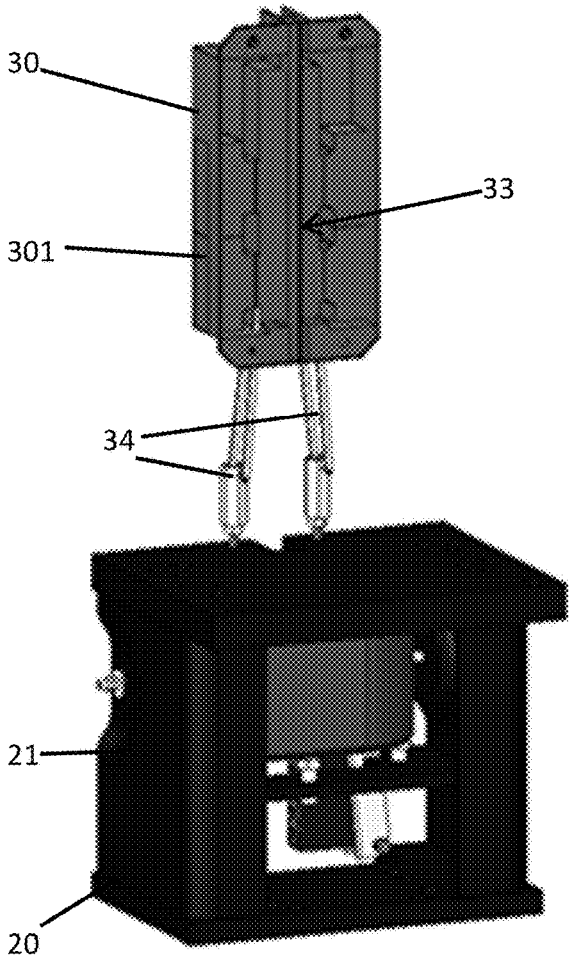
FIG. 3 is a perspective view of a safety and an electronic safety actuator (ESA) associated with the safety in accordance with embodiments.
Figure 4:
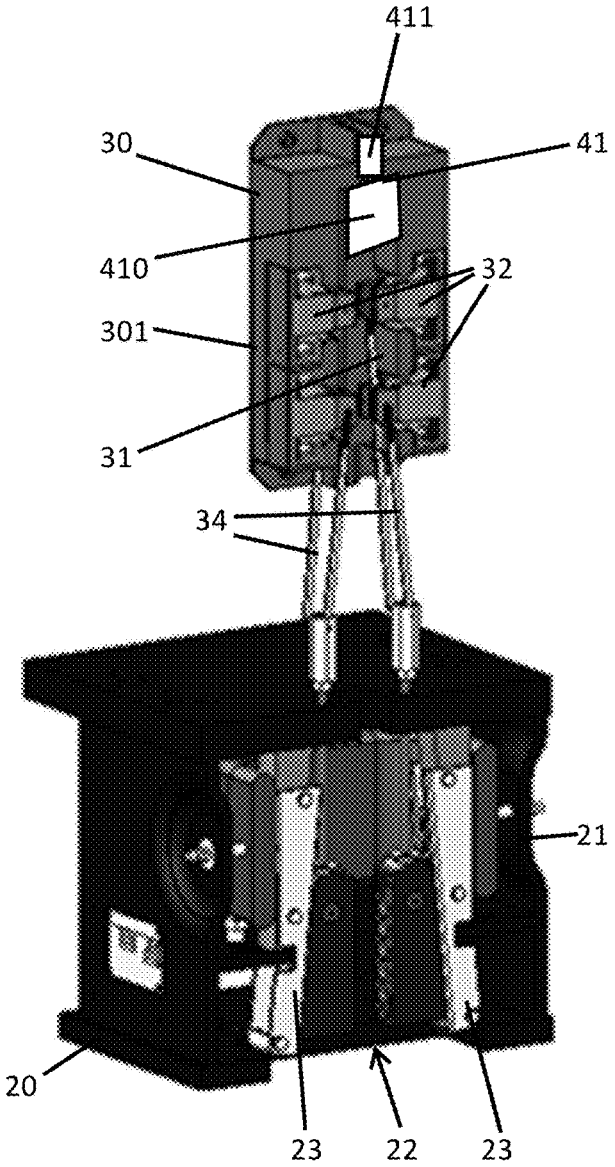
FIG. 4 is a perspective view of the safety and the ESA of FIG. 2 from another angle.

With continued reference to FIGS. 1 and 2 and with additional reference to FIGS. 3 and 4, the safety features of the elevator system 10 include safeties 20 and electrical safety actuators (ESAs) 30.

The safeties 20 may each be affixed to opposite sides of the elevator car 11 (although it is to be understood that the safeties 20 can be affixed to a same side or to adjacent sides of the elevator car 11 and that multiple safeties 20 can be affixed to a particular side of the elevator car 11) so that each safety 20 is at least proximate to a corresponding guide rail 12. Each safety 20 is configured to occupy an engaged position relative to the corresponding guide rail 12 or an unengaged position relative to the corresponding guide rail 12. In the engaged position, the safety 20 impedes movement of the elevator car 11 along the corresponding guide rail 12 and, in the unengaged position, the safety 20 permits movement of the elevator car 11 along the corresponding guide rail 12. The safeties 20 are normally provided in their unengaged positions.

As shown in FIGS. 3 and 4, the safeties 20 each include a safety body 21, a channel 22 that is defined through the safety body 21 and one or more wedge elements 23. When installed, the corresponding guide rail 12 extends through the channel 22. The wedge elements 23 are disposed in or proximate to the channel 22. When the safety 20 occupies the unengaged position, the wedge elements 23 do not engage or at least do not forcefully engage with the portion of the guide rail 12 in the channel 22. When the safety 20 occupies the engaged position, the wedge elements 23 engage with the portion of the guide rail 12 in a forceful manner that is sufficient to impede or prevent the elevator car 11 from moving. Such engagement is typically frictional and sufficient to slow or stop the elevator car 11 (particularly when each safety 20 occupies the engaged position).

While the wedge elements 23 can be provided as one or more wedge elements 23, the following description will relate only to the case in which a pair of wedge elements 23 are provided in each safety 20. This is done for purposes of clarity and brevity and is not intended to otherwise limit the scope of the disclosure.

In accordance with embodiments, the wedge elements 23 can be maneuvered relative to the safety body 21 in order to become engaged with the portion of the guide rail 12 in the channel 22.

The ESAs 30 are respectively coupled to corresponding safeties 20. Each ESA30 includes one or more permanent magnet assemblies 31 and electromagnetic actuators 32 (for purposes of clarity and brevity, the following description will relate to the cases in which each ESA 30 includes a single permanent magnet assembly 31). The permanent magnet assembly 31 is normally disposed at a distance D (see D1, D2 of FIG. 5) from a corresponding guide rail 12 and is deployable from the electromagnetic actuators 32 and across the distance D toward the corresponding guide rail 12 to thereby bring the corresponding safety 20 into the engaged position.

As shown in FIGS. 3 and 4, the ESAs 30 each include an ESA housing 301, the permanent magnet assembly 31, the electromagnetic actuators 32 and a power system 33 (see FIG. 3). The electromagnetic actuators 32 are disposed in the ESA housing 301 and are configured to generate a magnetic force that repels the permanent magnet assembly 31 when it is energized. The power system 33 could be integrally formed with the ESA30 or remote and is configured to provide the electromagnetic actuators 32 with power for energization. The permanent magnet assembly 31 is retained in the ESA housing 301 and is mechanically coupled to the wedge elements 23 of the corresponding safety 20 by way of one or more linkages 34. The permanent magnet assembly 31 includes a braking surface 310 (see FIG. 5) that engages or registers with the corresponding guide rail 12 when the permanent magnet assembly 31 is deployed.

While the permanent magnet assembly 31 is normally disposed at the distance D from the corresponding guide rail 12, the braking surface 310 of the permanent magnet assembly 31 may be brought into contact with the corresponding guide rail 12 when the electromagnetic actuators 32 are energized. The electromagnetic actuators 32 each include coils that are electrically coupled to the power system 33. The coils generate a magnetic flux when they are energized and a magnitude of this magnetic flux is sufficient to drive the permanent magnet assembly 31 toward and into the corresponding guide rail 12.

In accordance with alternative embodiments, the electromagnetic actuators 32 may be consistently energized with a loss of energization being the impetus for driving the permanent magnet assembly 31 toward the corresponding guide rail 12. In accordance with still further embodiments, additional biasing elements may be provided to drive or to assist in the driving of the permanent magnet assembly 31 toward the corresponding guide rail 12. The following description will relate only to the case in which the energization of the electromagnetic actuators 32 is the driving mechanism by which the permanent magnet assembly 31 is driven toward the corresponding guide rail 12. This is done for purposes of clarity and brevity and is not intended to otherwise limit the scope of the disclosure.

In accordance with embodiments, the electromagnetic actuators 32 may be disposed as a singular element in the ESA housing 301. In accordance with further embodiments, where the electromagnetic actuators 32 are provided as multiple elements in each ESA housing 301, the electromagnetic actuators 32 may be arranged substantially symmetrically within the ESA housing 301. More particularly, the multiple electromagnetic actuators 32 may be disposed substantially symmetrically about a center-line of the ESA housing 301.

When the braking surface 310 of the permanent magnet assembly 31 of the ESA30 is driven into the corresponding guide rail 12, magnetic attraction between the permanent magnet assembly 31 and the corresponding guide rail 12 creates a frictional contact between the braking surface 310 and the corresponding guide rail 12 which in turn causes the permanent magnet assembly 31 to exert a pulling or pushing force on the linkages 34 that causes the wedge element(s) 23 to engage with the portion of the corresponding guide rail 12 in the channel 22.

Still referring to FIGS. 2-4, the elevator system 10 further includes a sensing system 40 and a control system 50. The sensing system 40 is configured to determine the respective distances D between each permanent magnet assembly 31 of each ESA30 and the corresponding guide rail 12. The control system 50 is configured to effectively deploy each permanent magnet assembly 31 of each ESA30 toward the corresponding guide rail 12 based on current conditions (i.e., a determination that the elevator 11 is descending excessively fast as in an over-speed condition or is accelerating excessively fast as in an over-acceleration condition and needs to be stopped). The control system 50 executes such deployment of the permanent magnet assembly 31 of each ESA30 with synchronization based on the respective distances D.

In accordance with embodiments, the sensing system 40 may include a sensor 41 that is disposed in or adjacent to the ESA housing 301 of each ESA30. This sensor 41 may include a magnetic element 410 and a Hall Effect sensor 411 that measures a magnetic force generated between the magnetic element 410 and the corresponding guide rail 12. The sensor 41 thus calculates the distance D as a function of a magnitude of the magnetic force. In accordance with various embodiments, the sensor 41 can include or be provided as any type of distance measuring sensor or element (e.g., optical, electrical, mechanical, etc.).

In accordance with embodiments, the control system 50 may include a controller 51 that is communicative with each ESA 30 by way of wired or wireless connections. More particularly, the controller 51 of the control system 50 may be configured to provide power to the electromagnetic actuators 32 in order to energize the electromagnetic actuators 32 by way of power lines 52 and may be receptive of sensing results from the sensors 41 by way of signal lines 53. During operations of the elevator system 10, the controller 51 calculates a response time for each ESA30 as well as delay times for each ESA30 from the sensing results of each sensor 41 and controls the energization of the electromagnetic actuators 32 and thus the deployments of the permanent magnet assembly 310 of each ESA30 accordingly.

In some cases, the control system 50 may be distributed with control system elements disposed locally within each ESA30. In such cases, the local elements may execute deployments based on a certain time period required for synchronization with, for example, the most distant permanent magnet assembly 31.

As a general matter, though, the response times for each ESA30 are based on the respective distances D between the permanent magnet assemblies 31 and the corresponding guide rails 12. The response times may also be based on the time required for the electromagnetic actuators 32 to be energized (i.e., more time for slower actuation and vice versa), the time required for the permanent magnet assemblies 31 to traverse the respective distances D upon energization (i.e., more time for greater distances and vice versa) and the time required for the permanent magnet assemblies 31 to cause the wedge elements 23 to engage with the corresponding guide rails 12 (i.e., more time for slower engagements and vice versa).

Figure 5:
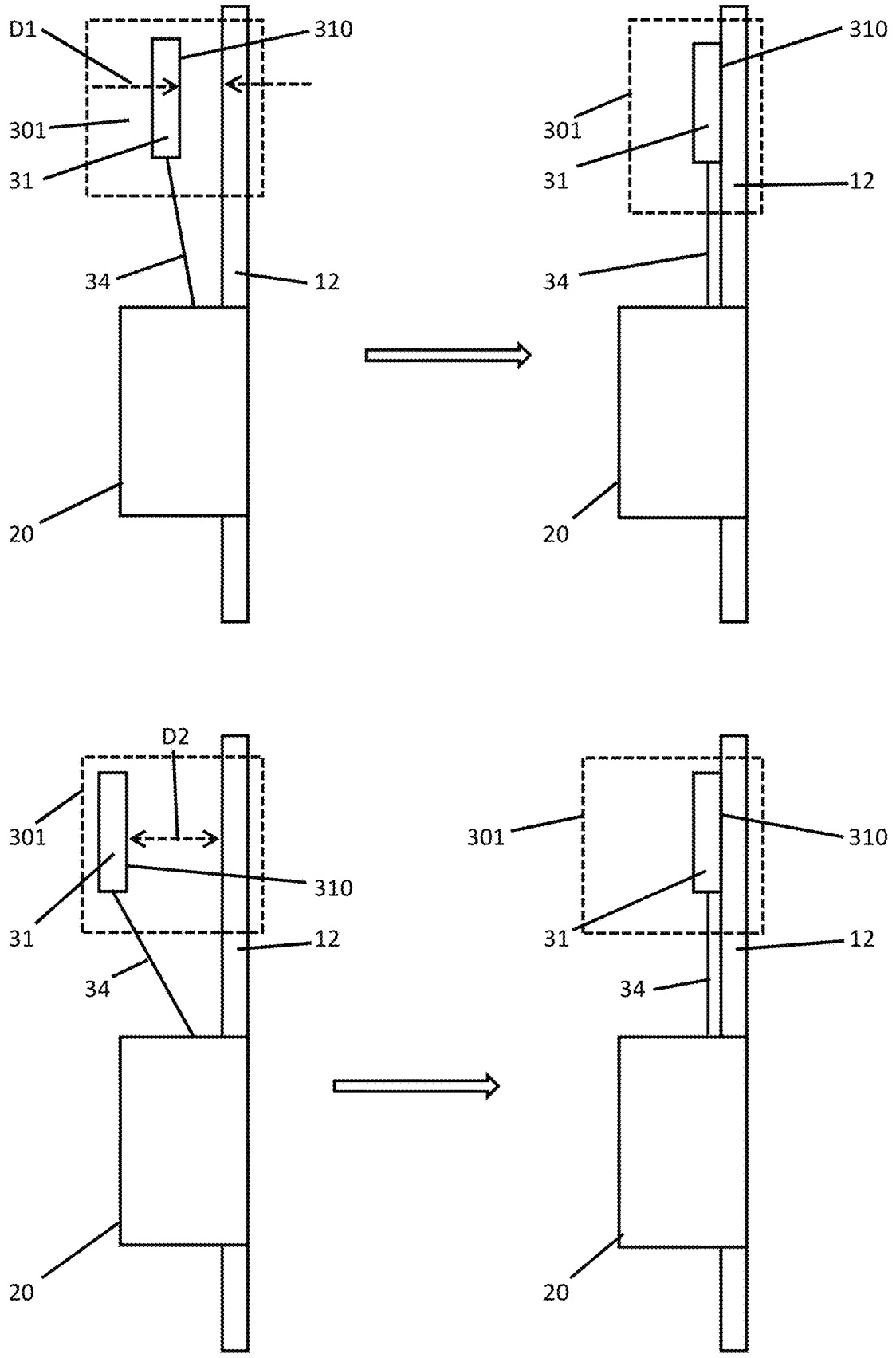
FIG. 5 is a side view of an operation of the safety and the ESA of FIGS. 3 and 4.

With reference to FIG. 5, since the respective distances D1 and D2 between each permanent magnet assembly 31 and the corresponding guide rails 12 may be different from one another, the response times for each ESA30 may also be different. The delay times are defined to effectively stagger the deployments of each permanent magnet assembly 31 so that they all cause the permanent magnet assemblies 31 to engage with the corresponding guide rails 12 at substantially a same time and possibly so that the safeties 20 occupy the engaged positions at a substantially same time. That is, in an event that one of the permanent magnet assemblies 31 is slightly closer to its guide rail 12 than the other (in an elevator system 10 with two guide rails 12) as determined by the sensors 41 at an instance at which the elevator car 11 needs to be stopped, the control system 50 will delay the deployment of the closer permanent magnet assembly 31 (e.g., the permanent magnet assembly 31 at the upper portion of FIG. 5) until the other permanent magnet assembly 31 (e.g., the permanent magnet assembly 31 at the lower portion of FIG. 5) is deployed. That way, as shown in FIG. 5, the two permanent magnet assemblies 31 will each come into contact with the corresponding guide rails 12 at a substantially same time so that the corresponding safeties 20 engage substantially simultaneously.

The response times for each ESA 30 may also be different due to characteristic capabilities of each ESA 30. This is especially true if various ESAs 30 in a given elevator system 10 are manufactured differently or have different components but may be due to machining tolerances of same or very similar ESAs 30 as well. In such cases, the differences in the response times can be established during testing periods as responsiveness characteristics of each ESA 30 and then taken into account in the calculations of the response times and ultimately the delay times.

Figure 6:
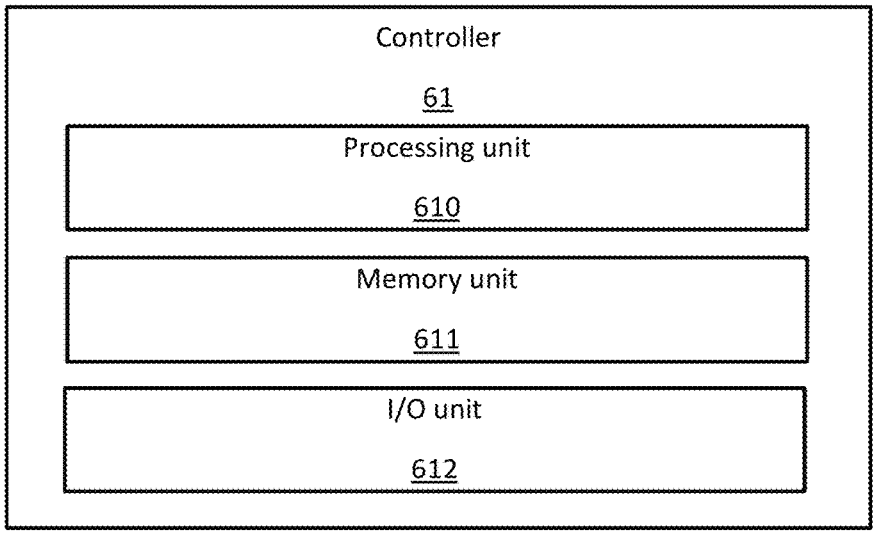
FIG. 6 is a schematic diagram of a controller of the elevator system of FIGS. 1 and 2 in accordance with embodiments.

With reference to FIG. 6, the controller 51 of the control system 50 may include a processing unit 610, a memory unit 611 and an input/output (I/O) unit 612 by which the processing unit 610 can be coupled to the power lines 52 and the electromagnetic actuators 32 and to the signal lines 53 and the sensors 41. The memory unit 611 has executable instructions stored thereon that are readable and executable by the processing unit 610. When the executable instructions are read and executed by the processing unit 610, the executable instructions cause the processing unit 610 to operate as described herein. That is, the executable instructions cause the processing unit 610 to calculate the response and delay times based on the respective distances D and to control the deployments of the braking surfaces 310 with the synchronization based on an over-speed or an over-acceleration condition being in effect (i.e., when the elevator car 11 is in an over-speed or an over-acceleration condition and needs to be stopped).

In accordance with embodiments, the controller 51 can be centralized, distributed on each ESA30 or distributed on one ESA30 (i.e., a "smart" one of the ESAs30) and configured to direct the other ESAs 30 (i.e., the "dumb" ones) on when to deploy.

Figure 7:
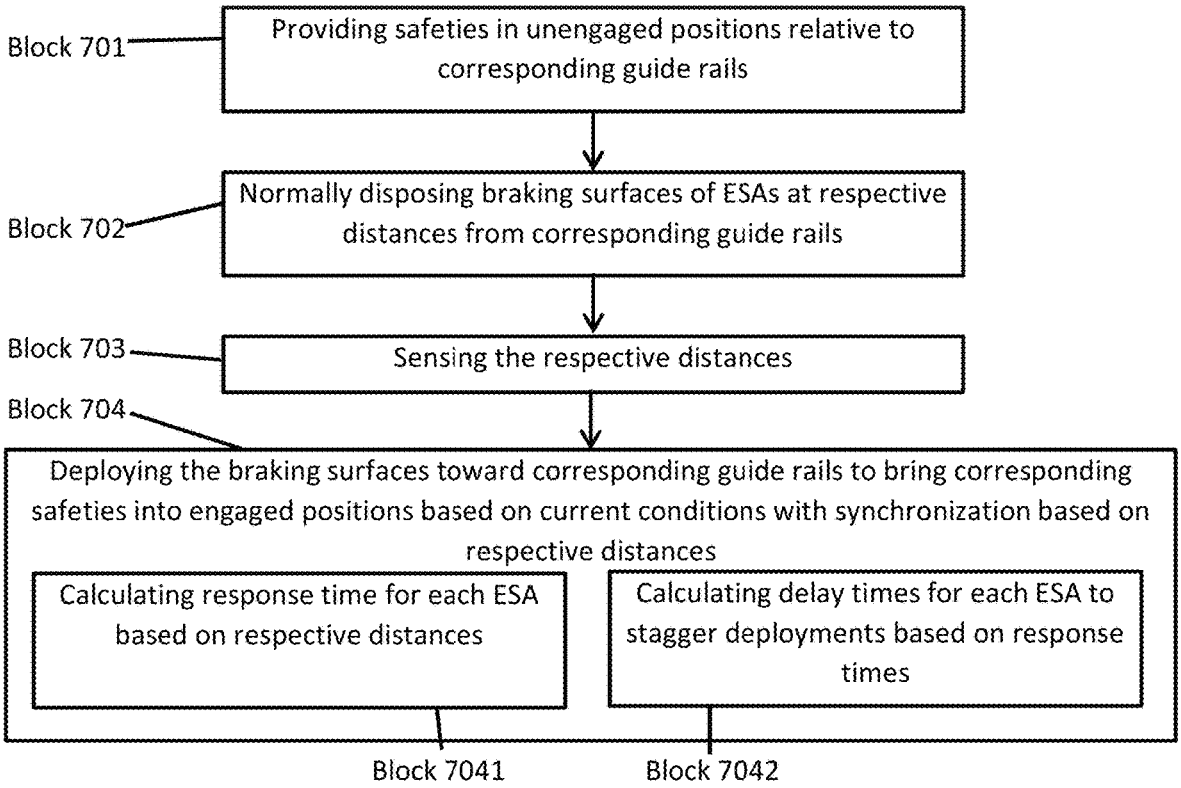
FIG. 7 is a flow diagram illustrating a method of operating an elevator system in accordance with embodiments.

With reference to FIG. 7, a method of operating the elevator system 10 is provided. As shown in FIG. 7, the method includes providing the safeties 20 in unengaged positions relative to the corresponding guide rails 12 (block 701), normally disposing the ESAs30 with the braking surfaces 310 at the respective distances D from the corresponding guide rails 12 (block 702), sensing the respective distances D (block 703) and deploying the braking surfaces 310 toward the corresponding guide rails 12 to bring the corresponding safeties 20 into the engaged positions based on an over-speed or an over-acceleration condition being in effect (i.e., the elevator car 11 is in an over-speed or an over-acceleration condition and needs to be stopped) with the synchronization based on the respective distances D (block 704).

In accordance with embodiments, as noted above, the deploying of the braking surfaces 310 of each of the ESAs 30 of block 704 may include calculating a response time for each ESA 30 based on the respective distances D (block 7041). The deploying of block 704 may also include calculating delay times for each ESA 30 to stagger deployments based on the response times (block 7042). The calculating operations of blocks 7041 and 7042 may be executed continuously, periodically or at a moment of deployment. The former cases might demand a significant amount of power and computing resources. The latter case might delay deployments.

Technical effects and benefits of the present disclosure are that Hall Effect sensors can detect the presence or strength of a magnetic field and can allow for the distance between an ESA and a guide rail to be measured. This distance is then used to synchronize ESA deployments to prevent excessive racking of an elevator car frame during an emergency stop situation.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An elevator system, comprising:

at least one guide rail;

a plurality of safeties to respectively selectively impede or permit movement of an elevator car along a corresponding guide rail;

first and second electronic safety actuators (ESAs) respectively coupled to at least one corresponding safety, the first ESA comprising a first braking surface located a first distance from the corresponding guide rail, the second ESA comprising a second braking surface located a second distance from the corresponding guide rail, and the first and second braking surfaces deployable across the first and second distances, respectively, to contact the corresponding guide rails;

a sensing system to determine the first and second distances; and a control system to deploy the first and second braking surfaces toward the corresponding guide rails in response to an over-speed or an over-acceleration condition with synchronization based at least in part on the first and second distances.

2. The elevator system according to claim 1, wherein the sensing system comprises a sensor respectively disposed in or adjacent to each ESA.

3. The elevator system according to claim 2, wherein the sensor comprises a magnetic element and a Hall Effect sensor.

4. The elevator system according to claim 1, wherein the control system is configured to calculate:

a response time for each ESA based on the first and second distances, and delay times for each ESA to stagger deployments based on the response times.

5. An elevator system in which an elevator car moves along guide rails, the elevator system comprising:

safeties to occupy engaged or unengaged positions relative to a corresponding guide rail to impede or permit movement of the elevator car, respectively;

electronic safety actuators (ESAs) respectively coupled to a corresponding safety, each ESA comprising a braking surface that is:

normally disposed at a distance from a corresponding guide rail, and deployable toward the corresponding guide rail to bring the corresponding safety into the engaged position;

a sensing system to determine respective distances between each braking surface of each ESA and the corresponding guide rail; and a control system to deploy each braking surface of each ESA toward the corresponding guide rail in response to an over-speed or an over-acceleration condition based at least in part on the respective distances.

6. The elevator system according to claim 5, wherein:

the safeties each comprise wedge elements configured to engage with the corresponding guide rail, and linkages are provided between each ESA and the corresponding safety.

7. The elevator system according to claim 5, wherein the ESAs each comprise:

a housing;

a permanent magnet assembly comprising the braking surface; and electromagnetic actuators disposed in the housing to generate magnetic force to repel the permanent magnet assembly toward the corresponding guide rail when energized.

8. The elevator system according to claim 7, wherein the electromagnetic actuators are symmetrically arranged in the housing.

9. The elevator system according to claim 7, wherein a power system by which the electromagnetic actuators are powered is coupled to the control system.

10. The elevator system according to claim 7, wherein the sensing system comprises a sensor respectively disposed in or adjacent to each ESA.

11. The elevator system according to claim 10, wherein the sensor comprises a magnetic element and a Hall Effect sensor.

12. The elevator system according to claim 5, wherein the control system comprises:

a controller coupled to the elevator car; and wiring by which the ESAs are communicative with the controller.

13. The elevator system according to claim 12, wherein the controller is centralized.

14. The elevator system according to claim 12, wherein the controller is distributed to each ESA.

15. The elevator system according to claim 12, wherein the controller is distributed to a smart one of the ESAs and controls the other ESAs.

16. The elevator system according to claim 5, wherein the control system is configured to calculate:

a response time for each ESA based on the respective distances, and delay times for each ESA to stagger deployments based on the response times.

17. A method of operating an elevator system in which an elevator car moves along guide rails, the method comprising:

providing safeties in unengaged positions relative to corresponding guide rails;

electronic safety actuators (ESAs), which are respectively coupled corresponding safeties, such that braking surfaces of the ESAs are at respective distances from corresponding guide rails;

sensing the respective distances; and deploying the braking surfaces toward the corresponding guide rails to bring the corresponding safeties into engaged positions based on an over-speed or an over-acceleration condition with synchronization based on the respective distances.

18. The method according to claim 17, wherein the deploying with synchronization comprises:

calculating a response time for each ESA based on the respective distances; and calculating delay times for each ESA to stagger deployments based on the response times.

19. The method according to claim 18, wherein the calculating of the response time for each ESA comprises:

testing each ESA;

determining responsiveness characteristics of each ESA from the testing; and calculating the response time for each ESA based on the respective distances and the determined responsiveness characteristics of each ESA.

* * * * *